US011025019B1

(12) United States Patent
Cheng et al.

(10) Patent No.: US 11,025,019 B1
(45) Date of Patent: Jun. 1, 2021

(54) DATA CABLE

(71) Applicant: VEETONE TECHNOLOGIES LIMITED, Shenzhen (CN)

(72) Inventors: Haihua Cheng, Shenzhen (CN); Qunying Tang, Shenzhen (CN)

(73) Assignee: Veetone Technologies Limited, Shenzhen (CN)

( * ) Notice: Subject to any disclaimer, the term of this patent is extended or adjusted under 35 U.S.C. 154(b) by 0 days.

(21) Appl. No.: 17/044,803

(22) PCT Filed: Jul. 16, 2018

(86) PCT No.: PCT/CN2018/095748

§ 371 (c)(1),
(2) Date: Oct. 1, 2020

(87) PCT Pub. No.: WO2020/014809

PCT Pub. Date: Jan. 23, 2020

(51) Int. Cl.
*H01R 29/00* (2006.01)
*H01R 27/00* (2006.01)
(Continued)

(52) U.S. Cl.
CPC ..... *H01R 27/00* (2013.01); *H01R 13/514* (2013.01); *H01R 24/60* (2013.01); *H01R 31/06* (2013.01); *H01R 31/065* (2013.01)

(58) Field of Classification Search
CPC ..... H01R 27/00; H01R 27/02; H01R 13/514; H01R 24/60; H01R 31/06; H01R 31/065
(Continued)

(56) References Cited

U.S. PATENT DOCUMENTS 6,108,331 A * 8/2000 Thompson ..... H01R 27/02 348/E7.05
2017/0331217 A1 11/2017 Wang

FOREIGN PATENT DOCUMENTS

CN 202586005 U 12/2012
CN 202678664 U 1/2013
(Continued)

*Primary Examiner* — Khiem M Nguyen
(74) *Attorney, Agent, or Firm* — Muncy, Geissler, Olds & Lowe, P.C.

(57) ABSTRACT

The invention relates to a data cable including a data cable body and a first converter (40). The data cable body includes a cable (10) and a first connector (20) connected to a first end of the cable (10). The first converter (40) comprises a second connector (42) and a third connector (43) that are communicationally connected to each other. The first converter (40) is connected to the first connector (20) through a first flexible connection member (50). The junction between the first flexible connection member (50) and the first connector (20) deviates from a first joint (22) of the first connector (20) and/or the junction between the first flexible connection member (50) and the first converter (40) is close to the second connector (42). When the second connector (42) is located in a front direction, the second connector (42) can be inserted into the first joint (22). When the second connector (42) is located in an opposite direction, the first flexible connection member (50) is twisted, which makes the length of the twisted first flexible connection member (50) shortened, so that the second connector (42) cannot be inserted into the first joint (22). The transmission rate of a signal can be improved. The cost can be reduced through the data cable.

10 Claims, 8 Drawing Sheets

(51) Int. Cl.
*H01R 13/514* (2006.01)
*H01R 24/60* (2011.01)
*H01R 31/06* (2006.01)

(58) Field of Classification Search
USPC ..... 439/170–173, 620.1
See application file for complete search history.

(56) References Cited

FOREIGN PATENT DOCUMENTS

| | | | |
|---|---|---|---|
| CN | 203883284 | U | 10/2014 |
| CN | 206135135 | U | 4/2017 |
| CN | 206542046 | U | 10/2017 |

* cited by examiner

| USB C | Core color | USB3.0MicroB |
|---|---|---|
| A1,B1,A12,B12 | Gound | 5 |
| | Drain wire | 8 |
| A4,B4,A9,B9 (VBUS) | Red | 1 (VBUS) |
| A6 (UTP D+) | Green | 3 (D+) |
| A7 (UTP D−) | White | 2 (D−) |
| A2 (SDP1 TX+) | Orange | 7 (SS TX+) |
| A3 (SDP1 TX−) | Purple | 6 (SS TX−) |
| B11 (SDP2 RX+) | Yellow | 10 (SS RX+) |
| B10 (SDP2 RX−) | Blue | 9 (SS RX−) |
| Shell | Braiding | Shell |

DATA CABLE

TECHNICAL FIELD

The present invention relates to the field of electronic product accessories, and more particularly, to a data cable.

BACKGROUND

With continuous development and improvement of a USB-C (formally known as USB Type-C) technology, a USB-C interface has been widely used between electronic devices. A new generation of USB-C to USB-C data cable with a transmission rate of 5 Gbps (the first generation) or 10 Gbps (the second generation) has become standard wiring of the electronic devices. The USB-C to USB-C data cable comprises a cable and two USB-C connectors (such as male connectors) respectively connected to both ends of the cable. However, there are still many electronic devices which only have a USB 3.0 A female connector or a USB 3.0 Micro B connector currently. Therefore, users need a USB 3.0 A or USB 3.0 Micro B to USB-C data cable, which comprises a cable as well as a USB 3.0 A connector (such as a USB 3.0 A male connector) or a USB 3.0 Micro B connector (such as a USB 3.0 Micro B male connector) and a USB-C connector (such as a USB-C male connector) that are respectively connected to both ends of the cable. Therefore, the users need the USB-C to USB-C data cable and the USB 3.0 A or USB 3.0 Micro B to USB-C data cable to meet daily use.

At present, there is a USB-C female converter, which has a USB 3.0 A male connector or a USB 3.0 Micro B male connector and a USB-C female connector at both ends respectively, so that the USB 3.0 A or USB 3.0 Micro B to USB-C data cable is formed after the USB-C male connector of the USB-C to USB-C data cable is inserted into the USB-C female connector. The converter meets the daily use of the users. However, the USB-C male connector may be inserted forwardly and backwardly (which means that the USB-C male connector can also be inserted into the USB-C female connector after rotating by 180 degrees), while the USB 3.0 A or USB 3.0 Micro B male connector cannot be inserted forwardly and backwardly. Therefore, a detection and switching circuit needs to be arranged in a USB 3.0 A or USB 3.0 Micro B to USB-C converter. The detection and switching circuit is used for detecting whether the USB-C male connector is inserted forwardly or inserted backwardly, and switching a corresponding circuit according to a detection result to ensure USB 3.0 A or USB 3.0 Micro B to USB-C conversion. The detection and switching circuit leads to time latency and loss of energy, resulting in certain distortion of high-frequency signals and reduction of a transmission rate of a signal. In addition, the detection and switching circuit increases the cost of a USB 3.0 A or USB 3.0 Micro B to USB-C female converter and lowers yield.

In addition, the USB-C to USB-C data cable may have an e-marker circuit, which is used for generating configuration channel (CC) signals of USB C. When the above converter is connected to the USB-C to C data cable, if the users connect a USB-C electronic device first and then connect a USB 3.0 A or USB 3.0 Micro B electronic device, the configuration channel signals may probably interfere with the USB 3.0 A or USB 3.0 Micro B electronic device, resulting in abnormal USB enumeration, which means that the USB-C female converter connected to the USB-C to C data cable may fail to operate normally. Users need to connect the USB 3.0 A or USB 3.0 Micro B electronic device first and then connect the USB-C electronic device for normal use.

SUMMARY

One objective of the present invention is to provide a data cable with a high transmission rate of a signal and a low cost.

The present invention provides a data cable comprising a data cable body and a first converter, wherein the data cable body comprises a cable and a first connector connected to a first end of the cable, the first converter comprising a second connector and a third connector that are communicationally connected to each other, shapes of the first connector and the second connector allowing the second connector to be inserted into a first joint of the first connector in both front and opposite directions, the first converter being connected to the first connector through a first flexible connection member, the junction between the first flexible connection member and the first connector deviating from the first joint of the first connector and/or the junction between the first flexible connection member and the first converter being close to the second connector; when the second connector is located in the front direction, the second connector is able to be inserted into the first joint; when the second connector is located in the opposite direction, the first flexible connection member is twisted, which makes the length of the twisted first flexible connection member shortened, so that the second connector is unable to be inserted into the first joint.

Further, the third connector is a connector which is only able to be plugged in one side.

Further, the first converter is provided with a high-frequency filter circuit for filtering useless high-frequency interference signals transmitted from a CC Pin of the first connector.

Further, the high-frequency filter circuit comprises a bypass capacitor, a first pole of the bypass capacitor being electrically connected to a terminal of the second connector, a second pole of the bypass capacitor being grounded.

Further, the first pole is connected in series to a terminal of the third connector through a first resistor or grounded through a second resistor.

Further, the first flexible connection member is a PVC connecting rope or a silica gel connecting rope.

Further, the data cable body further comprises a fourth connector connected to a second end of the cable; the first connector and the fourth connector are both USB-C male connectors, the second connector being a USB-C female connector, the third connector being a USB A male connector or a USB Micro B male connector.

Further, the data cable body further comprises a fourth connector connected to a second end of the cable; the data cable further comprises a second converter, the second converter comprising a fifth connector and a sixth connector that are communicationally connected to each other, shapes of the fourth connector and the fifth connector allowing the fifth connector to be inserted into a fourth joint of the fourth connector in both front and opposite directions, the second converter being connected to the fourth connector through a second flexible connection member, the junction between the second flexible connection member and the fourth connector deviating from the fourth joint of the fourth connector and/or the junction between the second flexible connection member and the second converter being close to the fifth connector; when the fifth connector is located in the front direction, the fifth connector is able to be inserted into the fourth joint; when the fifth connector is located in the opposite direction, the second flexible connection member is twisted, which makes the length of the twisted second flexible connection member shortened, so that the fifth connector is unable to be inserted into the fourth joint.

Further, the first connector and the fourth connector are both USB-C male connectors, the second connector and the fifth connector being USB-C female connectors, the third connector being a USB A male connector, and the sixth connector being a USB Micro B male connector.

Further, the second flexible connection member has a same structure as that of the first flexible connection member; the first flexible connection member and the second flexible connection member are both PVC connecting ropes or silica gel connecting ropes.

When the present invention is implemented, the converter may be provided without the detection and switching circuit, so that a transmission rate of a signal can be improved and a cost can be reduced.

DETAILED DESCRIPTION

The present invention is further described hereinafter with reference to the accompanying drawings and the embodiments.

First Embodiment

Figure 1:
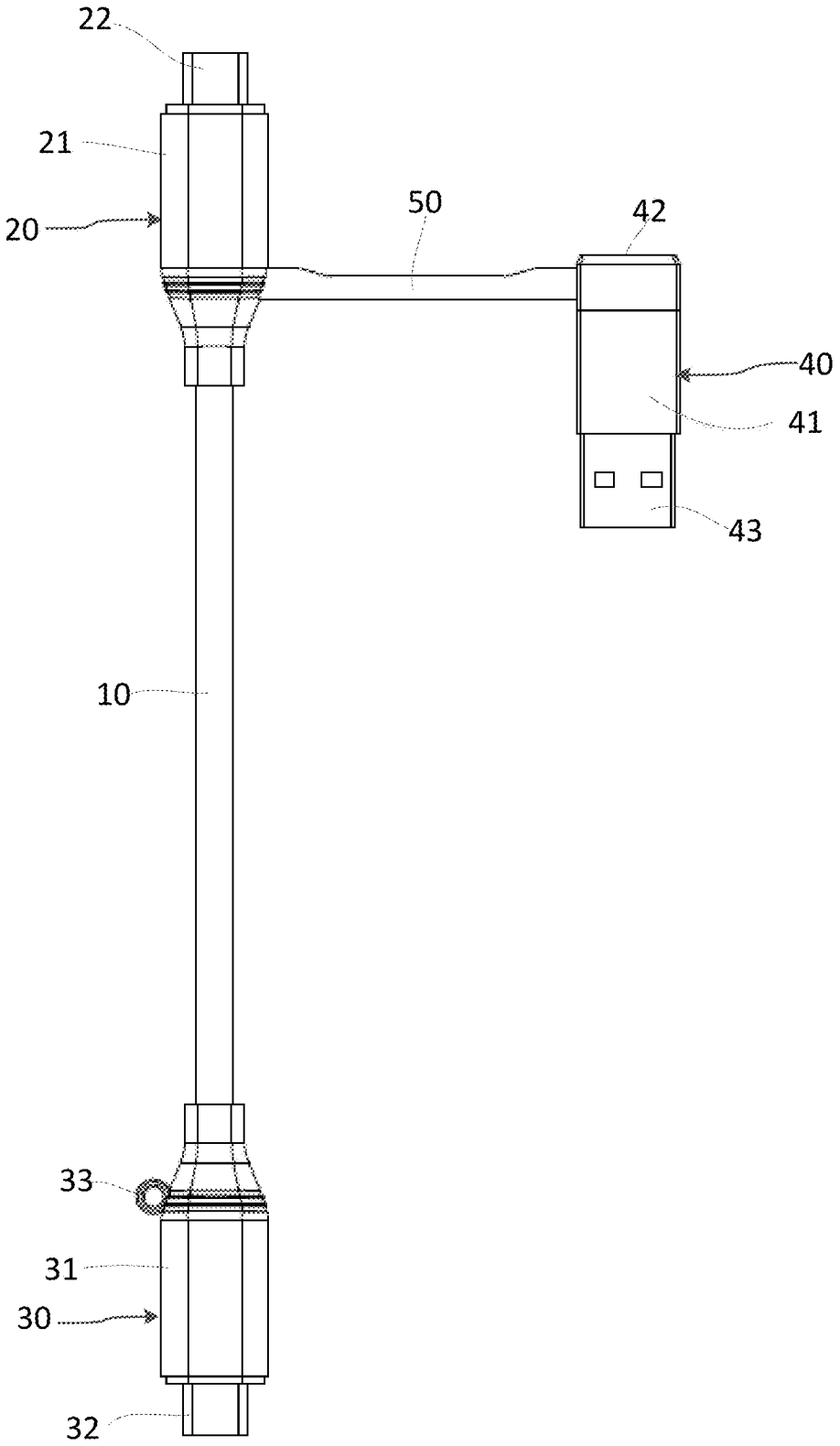
FIG. 1 is a structure diagram of a data cable provided in a first embodiment of the present invention.
Figure 2:
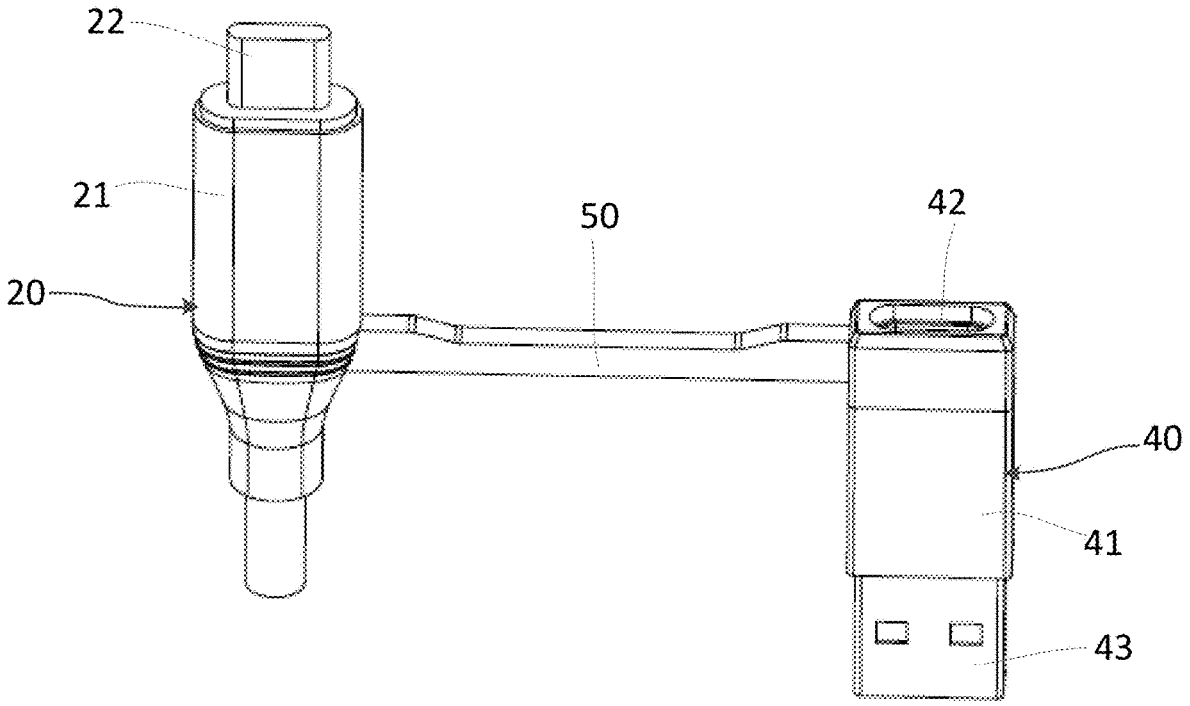
FIG. 2 is a structure diagram of a first connector, a first flexible connection member and a first converter of the data cable shown in FIG. 1.

With reference to FIG. 1 and FIG. 2, a data cable provided in the present invention comprises a data cable body and a first converter 40. The data cable body comprises a cable 10, a first connector 20 connected to a first end of the cable 10, and a fourth connector 30 connected to a second end of the cable 10. The first connector 20 comprises a first housing 21 connected to the first end of the cable 10 and a first joint 22 arranged at a first end of the first housing 21 far away from the cable 10. The fourth connector 30 comprises a fourth housing 31 connected to the second end of the cable 10 and a fourth joint 32 arranged at a second end of the fourth housing 31 far away from the cable 10. The first converter 40 comprises a second connector 42 and a third connector 43 that are communicationally connected to each other. Shapes of the first connector 20 and the second connector 42 allowing the second connector 42 to be inserted into the first joint 22 of the first connector 20 in both front and opposite directions. The third connector 43 is a connector which is only able to be plugged in one side.

The first converter 40 is connected to a right side of the first connector 20 through a first flexible connection member 50, thus being connected to the data cable body as a whole and being convenient to carry. The junction between the first flexible connection member 50 and the first connector 20 deviates from the first joint 22 of the first connector 20 and the junction between the first flexible connection member 50 and the first converter 40 is close to the second connector 42. When the second connector 42 is located in the front direction, the second connector 42 is able to be inserted into the first joint 22, when the second connector 42 is located in the opposite direction, the first flexible connection member 50 is twisted, and the length of the twisted first flexible connection member 50 is shortened, so that the second connector 42 is unable to be inserted into the first joint 22. In this way, the second connector 42 is ensured to be only able to be inserted into the first joint 22 of the first connector 20 in the front direction, thus ensuring normal operation of the Data cable. Moreover, compared with a traditional USB-C to C data cable with a USB-C female converter, no electronic switch (detection and switching circuit) is required, so that a transmission rate of a signal of the data cable is greatly improved, which can be increased by 20%, and a cost is greatly reduced at the same time.

In other embodiments, the junction between the first flexible connection member 50 and the first connector 20 deviates from the first joint 22 of the first connector 20 or the junction between the first flexible connection member 50 and the first converter 40 is close to the second connector 42. As long as one of the conditions is met, the second connector 42 is also ensured to be only able to be inserted into the first joint 22 of the first connector 20 in the front direction.

The above structure designs are both beneficial for reminding a user that the second connector 42 is inserted into the first connector 20.

In the embodiment, the first converter 40 further comprises a first converter housing 41, and the second connector 42 and the third connector 43 are respectively arranged at two ends of the first converter housing 41. The first flexible connection member 50 is connected between the first converter housing 41 and the first housing 21 of the first connector 20.

In practical application, the fourth joint 32 may be inserted into an interface of an electronic device matched with the fourth joint 32, the second connector 42 is inserted into the first joint 22, and then the third connector 43 is inserted into an interface of another electronic device matched with the third connector 43, thus realizing data transmission between two electronic devices with different interfaces. The two electronic devices with different interfaces are, for example, a mobile phone and a computer or a tablet computer.

In the embodiment, the first connector 20 and the fourth connector 30 are both USB-C male connectors. The second connector 42 is a USB-C female connector. The third connector 43 is a USB A male connector, and preferably, the third connector 43 is preferably a USB 3.0 A male connector.

Further preferably, the USB-C female connector is a USB-C female interface, and the USB 3.0 A male connector is a USB 3.0 A male joint. In this way, the data cable of the present invention may realize data transmission between an electronic device with a USB-C interface and an electronic device with a USB 3.0 A interface, such as data transmission between a mobile phone with the USB-C interface and a computer or a tablet computer with the USB 3.0 A interface. The data cable body of the present invention may realize a transmission rate of 5 Gbps (a switching bandwidth of a first generation) or 10 Gbps (a switching bandwidth of a second generation).

In other embodiments, the first connector 20 may be a USB-C connector, the fourth connector 30 may be a USB 2.0 A connector, a Mini USB connector or a Micro USB connector, and the second connector 42 may be a USB-C female connector. The third connector 43 is a USB A male connector, thus realizing data transmission between an electronic device with a USB 2.0 A interface, a Mini USB interface or a Micro USB interface and the electronic device with the USB 3.0 A interface.

Figure 3:
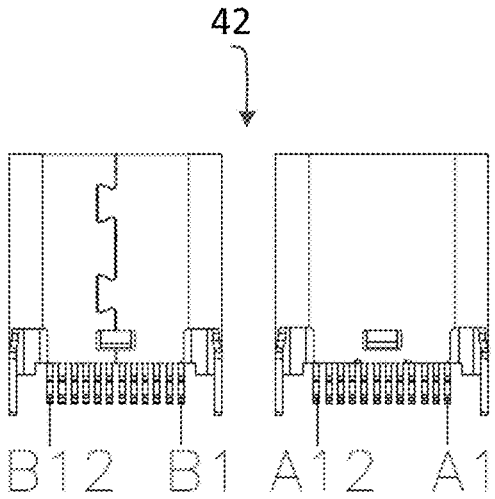
FIG. 3 is a structure diagram of a back surface and a front surface of a second connector of the first converter shown in FIG. 1.
Figure 4:
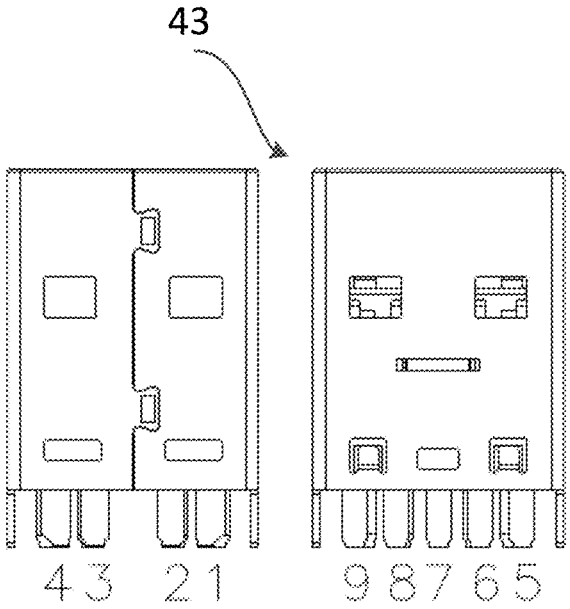
FIG. 4 is a structure diagram of a back surface and a front surface of a third connector of the first converter shown in FIG. 1.

With reference to FIG. 3, the USB-C female interface comprises a total of 24 Pins such as pins A1 to A12 and pins B1 to B12. With reference to FIG. 4, the USB 3.0 A male joint comprises a total of 9 Pins such as pins 1 to 9.

Figure 5:
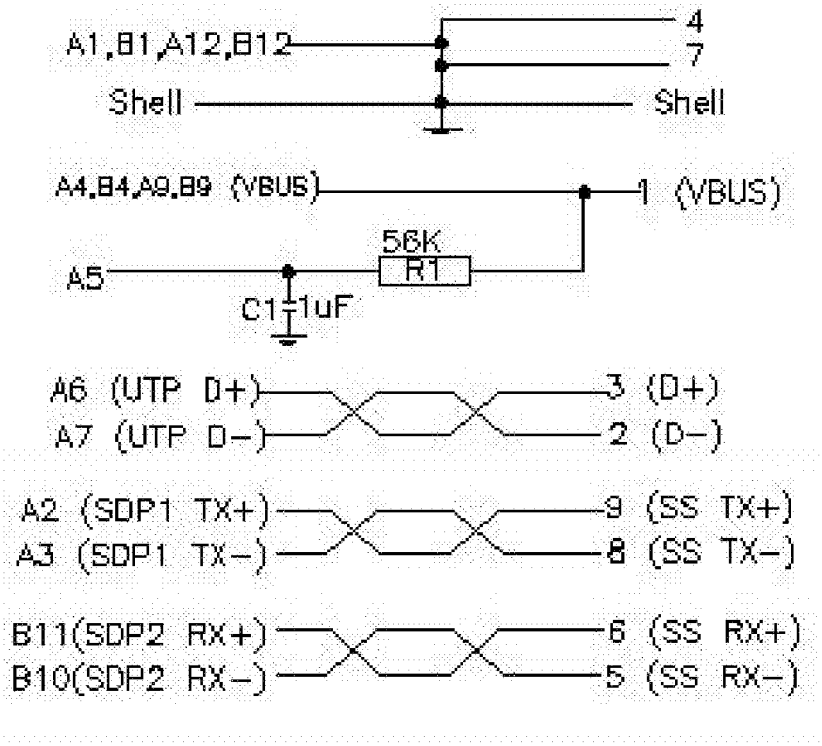
FIG. 5 is a principle diagram of wiring circuits of the second connector and the third connector shown in FIG. 1.

With reference to FIG. 5, in the embodiment, the first connector 20 and the fourth connector 30 are both the USB-C male connectors, and the third connector 43 is the USB A male connector. In the structure, the data cable body is a USB-C male to USB-C male data cable. Those skilled in the art may know that the USB-C male to USB-C male data cable may have an e-marker circuit, which is used for generating configuration channel (CC) signals of USB C. When the converter is connected to the data cable body, the data cable is equivalent to the USB-C male to USB A male data cable. If the user connects the USB-C male connector to the device first and then connects the USB A male connector to the device, the configuration channel signals generated through the e-marker circuit may affect the USB A male connector at the moment, thus affecting or hindering an enumeration process of the USB A male connector, resulting in unsuccessful connection of the data cable.

In order to solve the problem, in the embodiment, the first converter 40 is provided with a high-frequency filter circuit for filtering useless high-frequency interference signals (which are namely the configuration channel signals) transmitted from a CC (configuration channel) Pin of the first connector 20. The high-frequency filter circuit is preferably arranged in the first converter housing 41. The high-frequency filter circuit comprises a bypass capacitor C1, a first pole of the bypass capacitor C1 is electrically connected to a Pin A5 of the second connector 42, and a second pole of the bypass capacitor C1 is grounded. A capacity of the bypass capacitor C1 is preferably 1 microfarad (uF). The first pole is connected in series to a Pin 1 of the third connector 43 through a first resistor R1. The resistance value of the first resistor R1 is preferably 56K (K=thousand) ohms. Pins A4, B4, A9 and B9 of the second connector 42 are connected in parallel with the Pin 1 of the third connector 43. Pins A1, B1, A12 and B12 of the second connector 42 are connected in parallel with Pins 4 and 7 of the third connector 43. Pins A6, A7, A2, A3, B11 and B10 of the second connector 42 are respectively connected in series with Pins 3, 2, 9, 8, 6 and 5 of the third connector 43.

In the embodiment, the first converter housing 41, the first housing 21 and the first flexible connection member 50 are integrally formed, thus being convenient for manufacturing. Understandably, the first converter housing 41, the first housing 21 and the first flexible connection member 50 may also be separately formed.

In the embodiment, a cross-sectional shape of the first flexible connection member 50 is non-circular, such as a rectangle or a square.

The first flexible connection member 50 is a PVC connecting rope or a silica gel connecting rope, thus being convenient for bending, so that the second connector 42 is able to be inserted into the first joint 22 of the first connector 20. The first converter housing 41 and the first housing 21 are both PVC housings or silica gel housings. Understandably, the first flexible connection member 50, the first converter housing 41 and the first housing 21 may also be made of other flexible materials.

One side of a second housing 31 of the second connector 30 is provided with a connecting ring 33. The connecting ring 33 is arranged for being conveniently hung on other articles, thus being convenient for carrying or placing.

Second Embodiment

Figure 6:
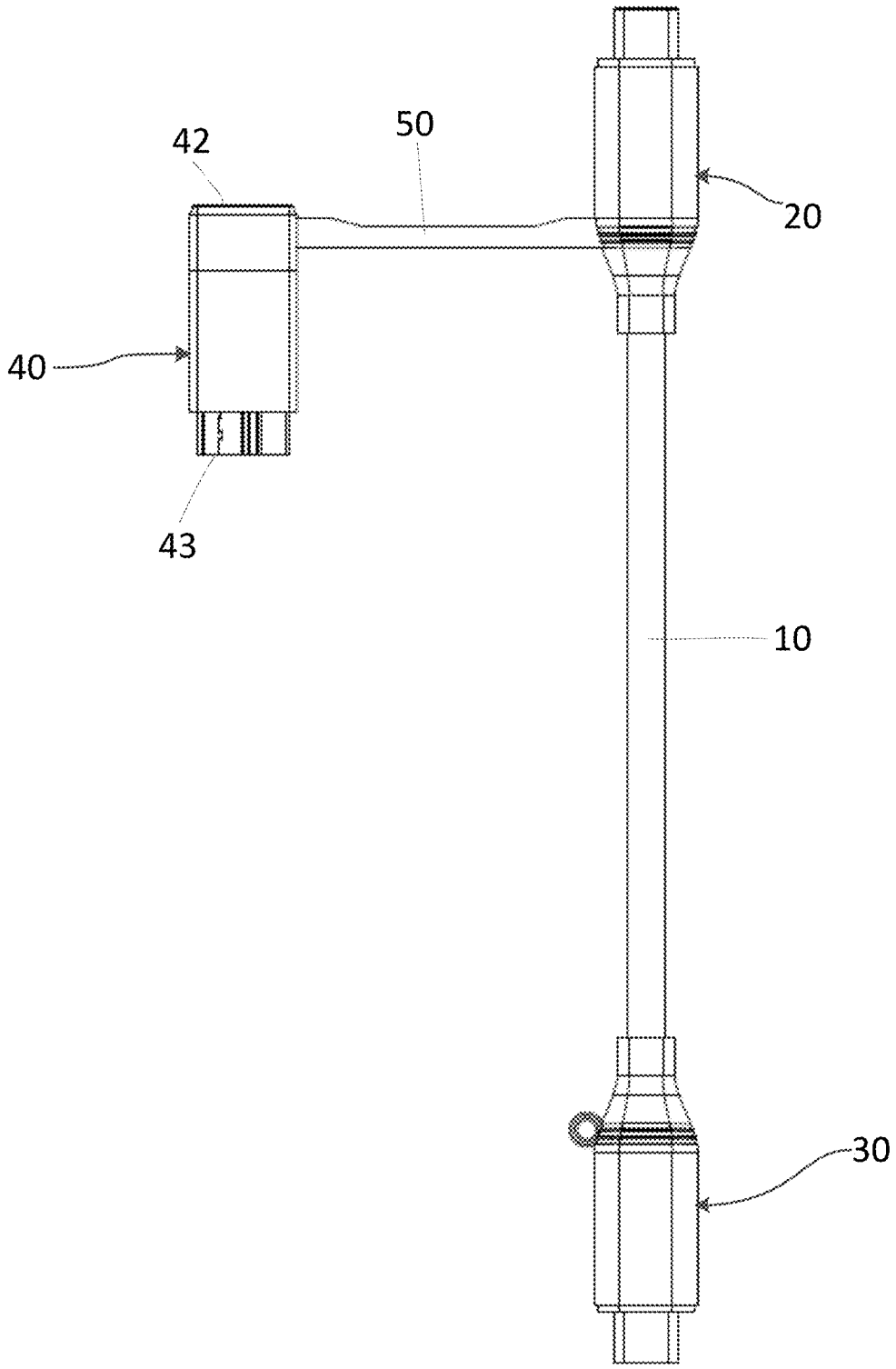
FIG. 6 is a structure diagram of a data cable provided in a second embodiment of the present invention.
Figure 7:
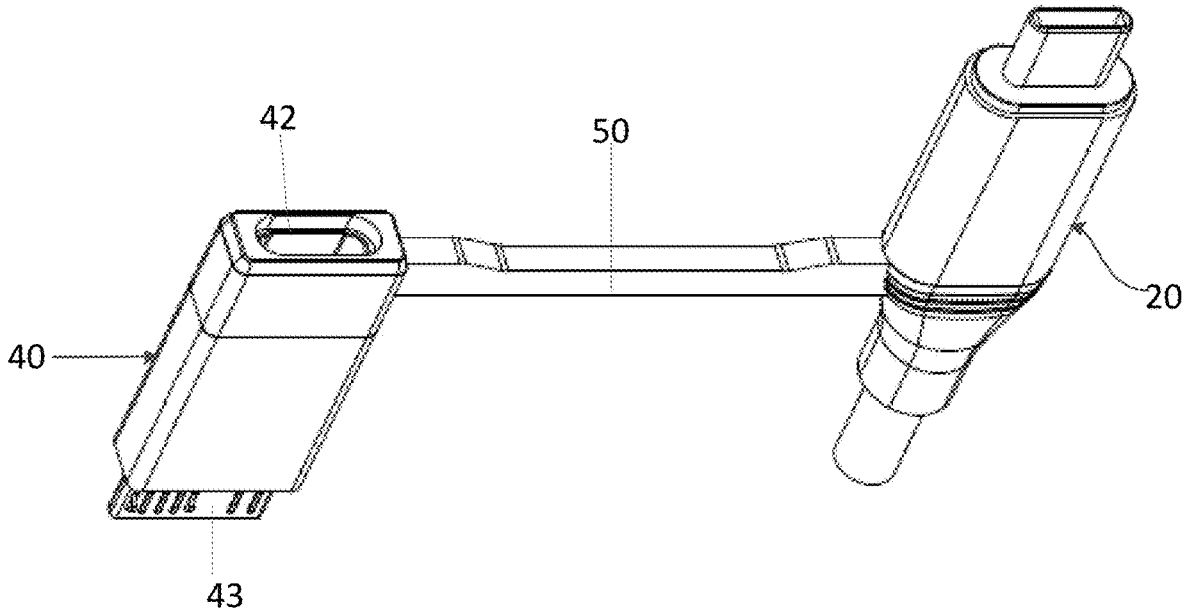
FIG. 7 is a structure diagram of a first connector, a first flexible connection member and a first converter of the data cable shown in FIG. 6.

With reference to FIG. 6 and FIG. 7, the embodiment is different from the first embodiment in that the first converter 40 is connected to a left side of the first connector 20 through the first flexible connection member 50, thus being connected to the data cable body as a whole.

In the embodiment, the first connector 20 and the fourth connector 30 are both USB-C male connectors. The second connector 42 is a USB-C female connector. The third connector 43 is a USB Micro B male connector, and preferably, the third connector 43 is preferably a USB 3.0 Micro B male connector.

Further preferably, the USB-C female connector is a USB-C female interface, and the USB 3.0 Micro B male connector is a USB 3.0 Micro B male joint. In this way, the data cable of the present invention may realize data transmission between an electronic device with a USB-C interface and an electronic device with a USB 3.0 Micro B interface, such as data transmission between a device with the USB 3.0 Micro B interface and a computer or a tablet computer with the USB-C interface.

Figure 8:
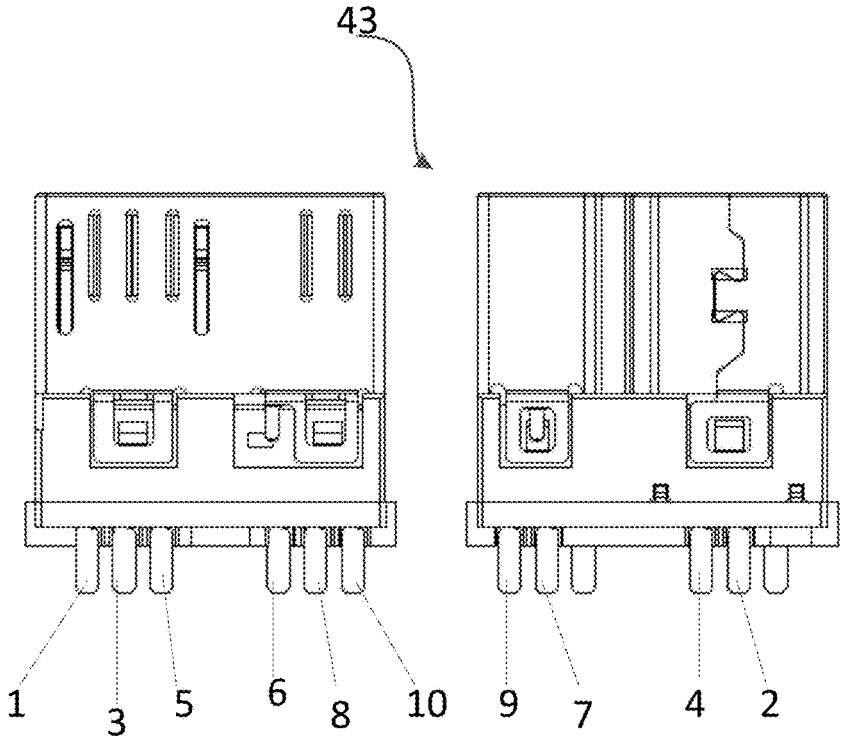
FIG. 8 is a structure diagram of a back surface and a front surface of a third connector of the first converter shown in FIG. 6.

With reference to FIG. 8, the third connector 43 is the USB 3.0 Micro B male joint, and comprises a total of 9 Pins such as pins 1 to 9.

Figure 9:
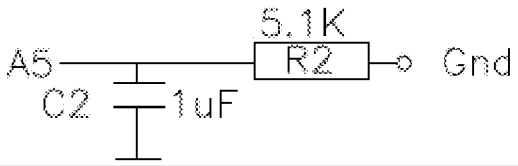
FIG. 9 is a wiring diagram of the second connector and the third connector of the first converter shown in FIG. 6 and a principle diagram of a wiring circuit of a bypass capacitor.

With reference to FIG. 9, the high-frequency filter circuit in the embodiment comprises a bypass capacitor C2, a first pole of the bypass capacitor C2 is electrically connected to a Pin A5 of the second connector 42, and a second pole of the bypass capacitor C2 is grounded through a second resistor R2. A capacity of the bypass capacitor C2 is preferably 1 microfarad (uF). A resistance value of the second resistor R2 is preferably 5.1K (K=thousand) ohms. The Pins A4, B4, A9 and B9 of the second connector 42 are connected in parallel with the Pin 1 of the third connector 43. The Pins A1, B1, A12 and B12 of the second connector 42 are connected in parallel with a Pin 5 of the third connector 43, and a Pin 8 of the third connector 43 is connected in parallel with an iron housing of the third connector 43. The Pins A6, A7, A2, A3, B11 and B10 of the second connector 42 are respectively connected in series with Pins 3, 2, 7, 6, 10 and 9 of the third connector 43.

Third Embodiment

Figure 10:
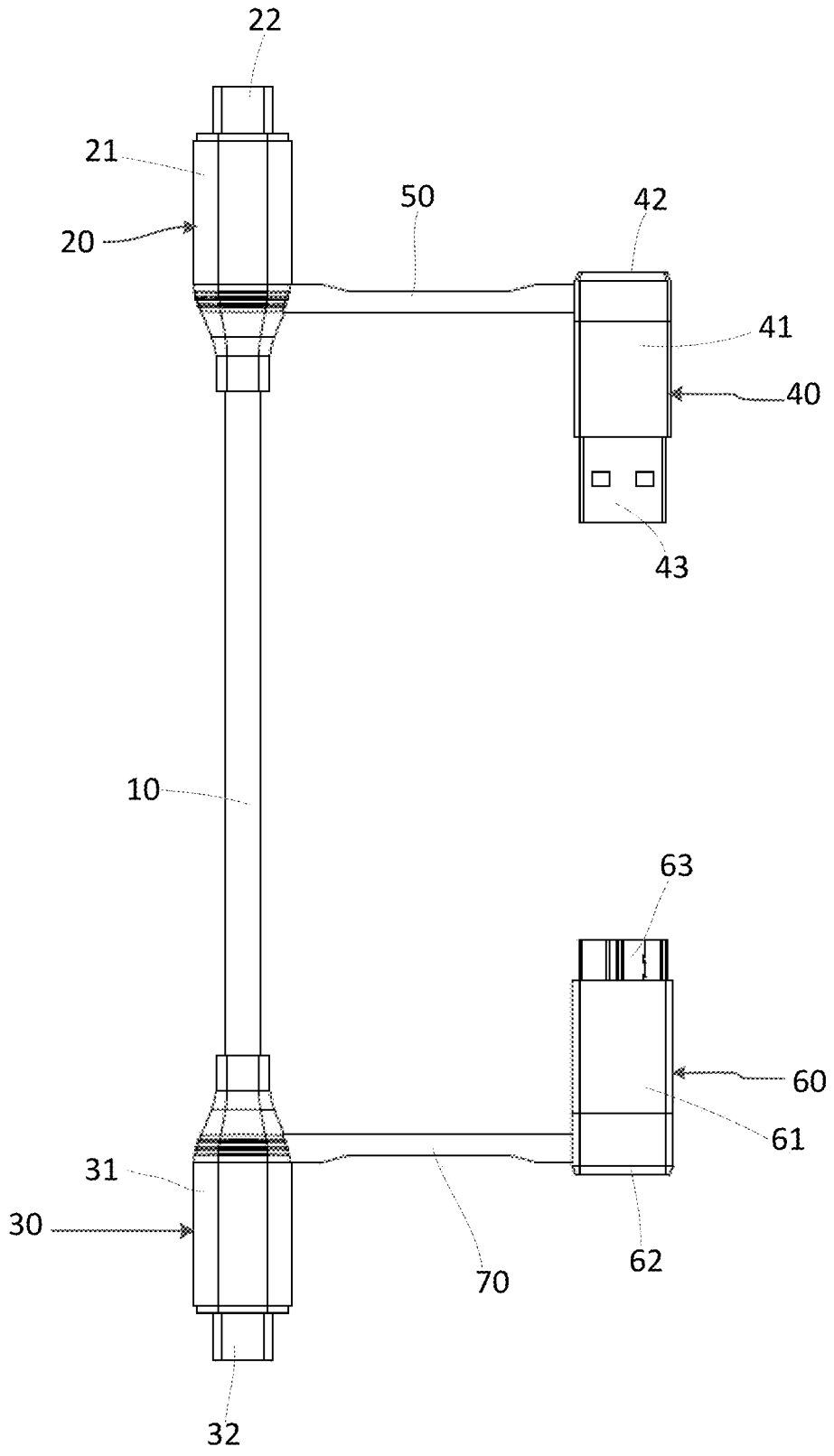
FIG. 10 is a structure diagram of a data cable provided in a third embodiment of the present invention.

With reference to FIG. 10, the embodiment is different from the first embodiment in that the data cable further comprises a second converter 60, and the second converter 60 comprises a fifth connector 62 and a sixth connector 63 that are communicationally connected to each other. Shapes of the fourth connector 30 and the fifth connector 62 allowing the fifth connector 62 to be inserted into the fourth joint 32 of the fourth connector 30 in both front and opposite directions. The first converter 40 is combined with the first connector 20, and the second converter 60 is combined with the fourth connector 30. The data cable of the present invention may realize a transmission rate of 5 Gbps (first generation) and a transmission rate of 10 Gbps (second generation).

The second converter 60 is connected to a right side of the fourth connector 30 through a second flexible connection member 70. The junction between the second flexible connection member 70 and the fourth connector 30 deviates from the fourth joint 32 of the fourth connector 30 and the junction between the second flexible connection member 70 and the second converter 60 is close to the fifth connector 62. When the fifth connector 62 is located in the front direction, the fifth connector 62 is able to be inserted into the fourth joint 32, when the fifth connector 62 is located in the opposite direction, the second flexible connection member 70 is twisted, and the length of the twisted second flexible connection member 70 is shortened, so that the fifth connector 62 is unable to be inserted into the fourth joint 32. In this way, the fifth connector 62 is ensured to be only able to be inserted into the fourth joint 22 of the fourth connector 30 in the front direction, thus ensuring normal operation of the Data cable.

In other embodiments, the junction between the second flexible connection member 70 and the fourth connector 30 deviates from the fourth joint 32 of the fourth connector 30 or the junction between the second flexible connection member 70 and the second converter 60 is close to the fifth connector 62. As long as one of the conditions is met, the fifth connector 62 is also ensured to be only able to be inserted into the fourth joint 32 of the fourth connector 30 in the front direction.

The above structure designs are both beneficial for reminding the user that the fifth connector 62 is inserted into the fourth connector 30.

In the embodiment, the second converter 60 further comprises a second converter housing 61, and the fifth connector 62 and the sixth connector 63 are respectively arranged at both ends of the second converter housing 61. The second flexible connection member 70 is connected between the second converter housing 61 and the fourth housing 31 of the fourth connector 30.

In the embodiment, the second converter housing 61, the fourth housing 31 and the second flexible connection member 70 are integrally formed, thus being convenient for manufacturing. Understandably, the second converter housing 61, the fourth housing 31 and the second flexible connection member 70 may also be separately formed.

The second flexible connection member 70 has a same structure as that of the first flexible connection member 50. The first flexible connection member 50 and the second flexible connection member 70 are both PVC connecting ropes or silica gel connecting ropes, thus being convenient for bending, so that the second connector 42 and the fifth connector 62 are able to be inserted into the first joint 22 of the first connector 20 and the fourth joint 32 of the fourth connector 30. The second converter housing 61 and the fourth housing 31 are both PVC housings or silica gel housings. Understandably, the first flexible connection member 50, the second flexible connection member 70, the first converter housing 41, the second converter housing 41, the first housing 21 and the fourth housing 31 may also be made of other flexible materials.

Cross-sectional shapes of the first flexible connection member 50 and the second flexible connection member 70 are non-circular, such as a rectangle or a square.

One side of the second housing 31 of the second connector 30 is provided with a connecting ring.

In the embodiment, the first connector 20 and the fourth connector 30 are both USB-C male connectors. The second connector 42 and the fifth connector 62 are USB-C female connectors. The third connector 43 is a USB A male connector, and preferably, the third connector 43 is preferably a USB 3.0 A male connector. The sixth connector 63 is a USB Micro B male connector, and preferably, the sixth connector 63 is preferably a USB 3.0 Micro B male connector.

Further preferably, the USB-C female connector is a USB-C female interface, and the USB 3.0 A male connector and the USB 3.0 Micro B male connector are respectively a USB 3.0 A male joint and a USB 3.0 Micro B male joint.

In this way, in practical application, the present invention may realize data transmission between an electronic device with a USB-C interface and an electronic device with a USB 3.0 A interface, and may also realize data transmission between the electronic device with the USB-C interface and an electronic device with a USB 3.0 Micro B interface. In addition, the first converter 40 is equivalent to the USB 3.0 A male joint after being inserted into the first connector 20, and the second converter 60 is equivalent to the USB 3.0 Micro B male joint after being inserted into the fourth connector 30. In this case, the Data cable of the present invention is equivalent to a USB 3.0 A to USB 3.0 Micro B data cable, thus realizing the data transmission between the electronic device with the USB 3.0 A interface and the electronic device with the USB 3.0 Micro B interface. The data cable of the present invention may realize a transmission rate of 5 Gbps or 10 Gbps, and which combination of joint is specifically selected depends on an actual situation, thus realizing multiple functions.

Fourth Embodiment

Figure 11:
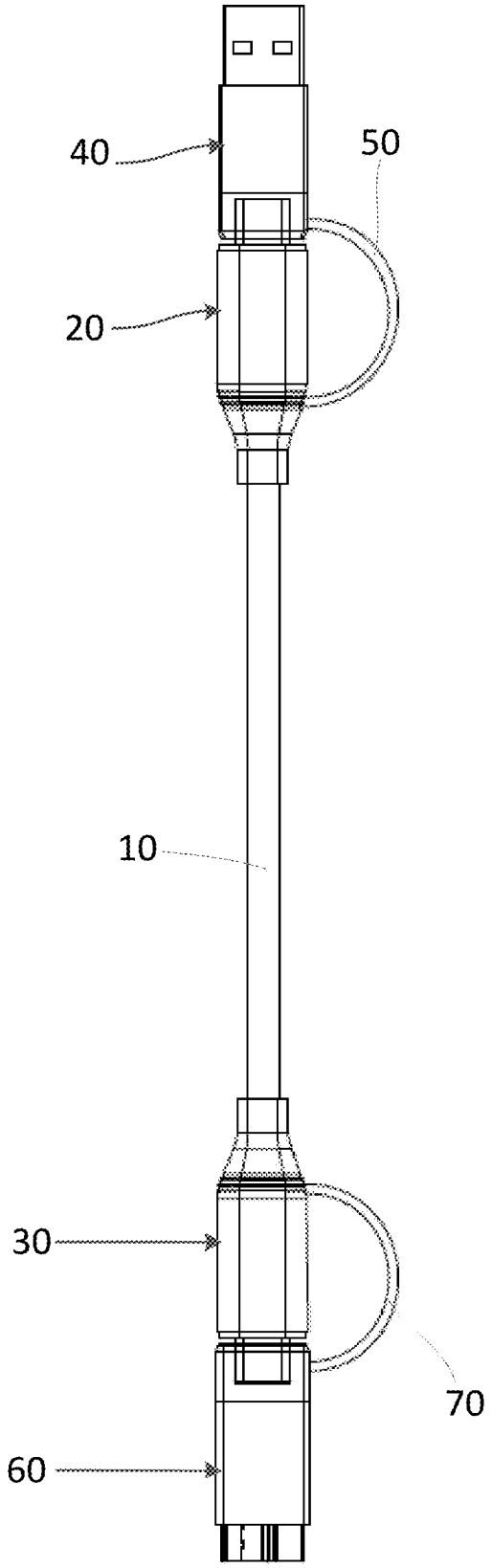
FIG. 11 is a structure diagram of a data cable provided in a fourth embodiment of the present invention.

With reference to FIG. 11, the embodiment is different from the third embodiment in that the cross-sectional shapes of the first flexible connection member 50 and the second flexible connection member 70 of the data cable are circular.

In other embodiments, the cross-sectional shapes of the first flexible connection member 50 and the second flexible connection member 70 may also be in other shapes, such as an ellipse, and the like.

The above embodiments only express the preferred embodiments of the present invention, and the descriptions thereof are specific and detailed, but the embodiments cannot be understood as limiting the scope of the patent of the present invention. It should be noted that those of ordinary skills in the art may further make several modifications and improvements without departing from the concept of the present invention, such as combining different features in various embodiments, and these modifications and improvements all fall within the scope of protection of the present invention.

The invention claimed is:

1. A data cable, comprising a data cable body and a first converter, the data cable body comprising a cable and a first connector connected to a first end of the cable, the first converter comprising a second connector and a third connector that are communicationally connected to each other, and shapes of the first connector and the second connector allowing the second connector to be inserted into a first joint of the first connector in both front and opposite directions, wherein the first converter is connected to the first connector through a first flexible connection member;

the junction between the first flexible connection member and the first connector deviates from the first joint of the first connector and/or the junction between the first flexible connection member and the first converter is close to the second connector;

when the second connector is located in the front direction, the second connector is able to be inserted into the first joint;

when the second connector is located in the opposite direction, the first flexible connection member is twisted, the length of the twisted first flexible connection member being shortened, so that the second connector is unable to be inserted into the first joint.

2. The data cable according to claim 1, wherein the third connector is a connector which is only able to be plugged in one side.

3. The data cable according to claim 2, wherein the first connector is a USB-C male connector; the first converter is provided with a high-frequency filter circuit for filtering useless high-frequency interference signals transmitted from a CC Pin of the first connector.

4. The data cable according to claim 3, wherein the high-frequency filter circuit comprises a bypass capacitor, a first pole of the bypass capacitor being electrically connected to a terminal of the second connector, a second pole of the bypass capacitor being grounded.

5. The data cable according to claim 4, wherein the first pole is connected in series to a terminal of the third connector through a first resistor or grounded through a second resistor.

6. The data cable according to claim 1, wherein the first flexible connection member is a PVC connecting rope or a silica gel connecting rope.

7. The data cable according to claim 1, wherein the data cable body further comprises a fourth connector connected to a second end of the cable; the first connector and the fourth connector being both USB-C male connectors, the second connector being a USB-C female connector, and the third connector being a USB A male connector or a USB Micro B male connector.

8. The data cable according to claim 1, wherein:

the data cable body further comprises a fourth connector connected to a second end of the cable;

the data cable further comprises a second converter, the second converter comprising a fifth connector and a sixth connector that are communicationally connected to each other, shapes of the fourth connector and the fifth connector allowing the fifth connector to be inserted into a fourth joint of the fourth connector in both front and opposite directions;

the second converter is connected to the fourth connector through a second flexible connection member;

the junction between the second flexible connection member and the fourth connector deviates from the fourth joint of the fourth connector and/or the junction between the second flexible connection member and the second converter is close to the fifth connector;

when the fifth connector is located in the front direction, the fifth connector is able to be inserted into the fourth joint; when the fifth connector is located in the opposite direction, the second flexible connection member is twisted, the length of the twisted second flexible connection member being shortened, so that the fifth connector is unable to be inserted into the fourth joint.

9. The data cable according to claim 8, wherein the first connector and the fourth connector are both USB-C male connectors, the second connector and the fifth connector being USB-C female connectors, the third connector being a USB A male connector, the sixth connector being a USB Micro B male connector.

10. The data cable according to claim 8, wherein the second flexible connection member has a same structure as that of the first flexible connection member; the first flexible connection member and the second flexible connection member are both PVC connecting ropes or silica gel connecting ropes.

* * * * *